US010682827B2

(12) United States Patent
Davis

(10) Patent No.: US 10,682,827 B2
(45) Date of Patent: Jun. 16, 2020

(54) FORMING STATION FOR FORMING PAIRS OF THREE SIDE SEAL POUCHES

(71) Applicant: Winpak Lane, Inc., San Bernardino, CA (US)

(72) Inventor: Steven Davis, San Bernardino, CA (US)

(73) Assignee: Winpak Lane, Inc., San Bernardino, CA (US)

( * ) Notice: Subject to any disclaimer, the term of this patent is extended or adjusted under 35 U.S.C. 154(b) by 205 days.

(21) Appl. No.: 15/690,733

(22) Filed: Aug. 30, 2017

(65) Prior Publication Data

US 2018/0056620 A1 Mar. 1, 2018

Related U.S. Application Data

(60) Provisional application No. 62/381,929, filed on Aug. 31, 2016.

(51) Int. Cl.

| | |
|---|---|
| ***B31B 70/26*** | (2017.01) |
| ***B31B 70/36*** | (2017.01) |
| *B31B 160/30* | (2017.01) |
| *B31B 150/10* | (2017.01) |
| *B31B 160/10* | (2017.01) |
| *B31B 155/00* | (2017.01) |

(52) U.S. Cl.

CPC ..... *B31B 70/28* (2017.08); *B31B 70/262* (2017.08); *B31B 70/36* (2017.08); *B31B 2150/10* (2017.08); *B31B 2155/0012* (2017.08); *B31B 2160/10* (2017.08); *B31B 2160/30* (2017.08)

(58) Field of Classification Search

CPC ..... B31B 70/28; B31B 70/30; B31B 2100/00; B31B 2110/20; B31B 2110/30; B31B 2110/35; B31B 2155/001

USPC ..... 493/248, 251, 250, 253, 254

See application file for complete search history.

(56) References Cited

U.S. PATENT DOCUMENTS

| | | | | | |
|---|---|---|---|---|---|
| 4,043,098 | A | * | 8/1977 | Putnam, Jr. | B65B 9/2028 53/551 |
| 5,564,259 | A | * | 10/1996 | Stolmeier | B65B 9/093 493/214 |
| D399,512 | S | * | 10/1998 | Davis | D15/135 |
| 6,006,501 | A | * | 12/1999 | Davis | B65B 9/2042 53/202 |
| D481,744 | S | * | 11/2003 | Kurth | B65B 9/213 D15/146 |

* cited by examiner

*Primary Examiner* — Hemant Desai
*Assistant Examiner* — Christopher Robin Kim
(74) *Attorney, Agent, or Firm* — The Watson IP Group, PLC; Jovan N. Jovanovic

(57) ABSTRACT

A forming station for forming pairs of three side seal pouches including a shaped outer top surface and an inner forming slot. The inner forming slot has an upper portion extending from an upper entry edge, and a transition portion. The inner forming slot may further include a lower portion.

19 Claims, 7 Drawing Sheets

FORMING STATION FOR FORMING PAIRS OF THREE SIDE SEAL POUCHES

CROSS-REFERENCE TO RELATED APPLICATION

This application claims priority from U.S. Pat. App. Ser. No. 62/381,929 filed Aug. 31, 2016, entitled "Forming Station For Forming Pairs Of Three Side Seal Pouches," the entire specification of which is hereby incorporated by reference in its entirety.

BACKGROUND OF THE DISCLOSURE

1. Field of the Disclosure

The disclosure relates in general to form, fill, seal filling equipment and the pouches formed thereby, and more particularly, to a forming station for forming pairs of three side seal pouches.

2. Background Art

The use of form, fill, seal filling equipment is known in the art. Film is continuously formed into a pouch shape and then sealed sufficient to create a fillable volume. Once filled, the final seal or seals are formed to close the pouch with the filled volume.

Generally, a forming station utilizes a former to direct film into the desired tubular configuration, which is then sealed and filled. The film is subject to pulling loads as well as forming loads while traversing the former. While sufficient progress has been made with such formers and such formers are currently in use, there has been a need for improvement.

As speeds of the film increase, problematically, it is often difficult to properly align the film to achieve high rates of pouch forming and filling. Additionally, it is often necessary to repeatedly adjust the film to maintain the proper position of the films within the equipment so as to preclude imperfections and alignment issues with the pouches. Furthermore, certain films react to formers such that use of conventional formers is not practicable with such films, despite the desire to utilize such films for packaging due to their benefits in the packaging context.

SUMMARY OF THE DISCLOSURE

The disclosure is directed, in one aspect, to a forming station for forming pairs of three side seal pouches comprising a shaped outer top surface, an inner forming slot having an upper portion and a transition portion defined thereby. The inner forming slot is substantially surrounded by the shaped outer top surface and meeting the same an upper entry edge. The upper portion includes a back wall, a front wall opposite the back wall, a first side curved portion and a second side curved portion opposite the first side curved portion. The first side curved portion and the second side curved portions span between the back wall and the front wall. The transition portion is downstream of the upper portion and includes a first central inwardly projecting surface extending inwardly from the back wall, and a second central inwardly projecting surface extending inwardly from the front wall. A first side inwardly projecting surface extends inwardly from the first side curved portion and a second side inwardly projecting surface extends inwardly from the second side curved portion.

In some configurations, the forming station includes a lower portion. The lower portion is positioned downstream of the transition portion. The lower portion includes a first side pouch shape, a second side pouch shape a first side opposing wall and a second side opposing wall. The first side pouch shape has a first inclined wall extending from the first central inwardly projecting surface, a second inclined wall extending from the second central inwardly projecting surface, and an arcuate outer wall extending from the first side inwardly projecting surface. The second side pouch shape has a first inclined wall extending from the first central inwardly projecting surface, a second inclined wall extending from the second central inwardly projecting surface, and an arcuate outer wall extending from the second side inwardly projecting surface. The first side opposing wall extends from the first central inwardly projecting surface between the first inclined wall of the first side pouch and the first inclined wall of the second side pouch. The second side opposing wall extends from the second central inwardly projecting surface between the second inclined wall of the first side pouch and the second inclined wall of the second side pouch.

In some configurations, the arcuate outer wall of the first side pouch shape is a continuous curve. Additionally, the arcuate outer wall of the second side pouch is a continuous curve.

In some configurations, the first side pouch shape and the second side pouch shape are substantially mirror image of each other taken about a plane that bisects the inner forming slot from the front wall to the back wall.

In some configurations, an initial width is defined between the front wall and the back wall of the upper portion. An initial length is defined between the first side curved portion and the second side curved portion. A final minimal width is defined between the first side opposing wall and the second side opposing wall. A final length is defied between the arcuate wall of the first side pouch shape and the arcuate wall of the second side pouch shape. In such a configuration, the initial width is greater than the final minimal width and the initial length is greater than the final length In some configurations, the arcuate outer wall of the first side pouch defines an arcuate outer wall width. The arcuate outer wall of the second side pouch likewise defines the arcuate outer wall width. The arcuate outer wall width is substantially identical to the initial width in at least a portion thereof.

In some configurations, the first central inwardly projecting surface further includes a first side edge and a second side edge, that extend downwardly and toward each other, such that a width of the first central inwardly projecting surface narrows in the downstream direction.

In some configurations, the second central inwardly projecting surface further includes a first side edge and a second side edge, that extend downwardly and toward each other, such that a width of the second central inwardly projecting surface narrows in the downstream direction.

In some configurations, the first side inwardly projecting portion has an upper edge and a lower edge. The upper edge and the lower edge meet at a first intersection proximate the first central inwardly projecting surface proximate a top edge thereof and at a second intersection proximate the second central inwardly projecting surface proximate a top edge thereof, to, in turn define a slice.

In some configurations, the second side inwardly projecting portion has an upper edge and a lower edge. The upper edge and the lower edge meet at a first intersection proximate the first central inwardly projecting surface proximate a top edge thereof and at a second intersection proximate the second central inwardly projecting surface proximate a top edge thereof, to in turn define a slice.

In some configurations, a portion of the first side pouch shape extends to the top edge of the first central inwardly projecting surface and the top edge of the second central inwardly projecting surface.

In some configurations, a portion of the second side pouch shape extends to the top edge of the first central inwardly projecting surface and the top edge of the second central inwardly projecting surface.

In some configurations, the first side opposing wall and the second side opposing wall of the lower portion are substantially parallel to each other, and of substantially the same size.

In some configurations, the top edge of the first central inwardly projecting surface and the top edge of the second central inwardly projecting surface, along with the upper edge of the first side inwardly projecting surface and the second side inwardly projecting surface cooperatively define a transition plane. The lower portion includes a lower exit edge at a lower end thereof. The lower exit edge defines a plane that is parallel to the transition plane In another aspect of the disclosure, the disclosure is directed to a forming station for forming pairs of three side seal pouches comprising a shaped outer surface and an inner forming slot that is defined by an upper portion, a lower portion and a transition portion. The upper portion includes a back wall, a front wall opposite the back wall, a first side curved portion and a second side curved portion opposite the first side curved portion, the first side curved portion and the second side curved portions spanning between the back wall and the front wall. The lower portion terminates with a lower exit edge. The lower portion includes a first side pouch shape and a second side pouch shape. Each pouch shape has a first inclined wall, a second inclined wall and an arcuate outer wall. The transition portion extends between the upper portion and the lower portion. The transition portion inwardly directs at least a portion of the front wall and the back wall into the first and second inclined walls of the first side pouch shape and the second side pouch shape, and inwardly directs the first side curved portion into the arcuate outer wall of the first side pouch shape and inwardly directing the second side curved portion into the arcuate outer wall of the second side pouch shape.

In some configurations, the arcuate outer wall of the first side pouch shape and the arcuate outer wall of the second side pouch shape are each continuous curves.

In some configurations, the first and second curved portion have a width that substantially matches a width of each of the arcuate outer wall of the first side pouch and the arcuate outer wall of the second side pouch.

In some configurations, the first and second curved portions are each continuous curves.

In some configurations, the first side pouch shape and the second side pouch shape are substantially mirror images of each other.

BRIEF DESCRIPTION OF THE DRAWINGS

The disclosure will now be described with reference to the drawings wherein.

DETAILED DESCRIPTION OF THE DISCLOSURE

Figure 1:
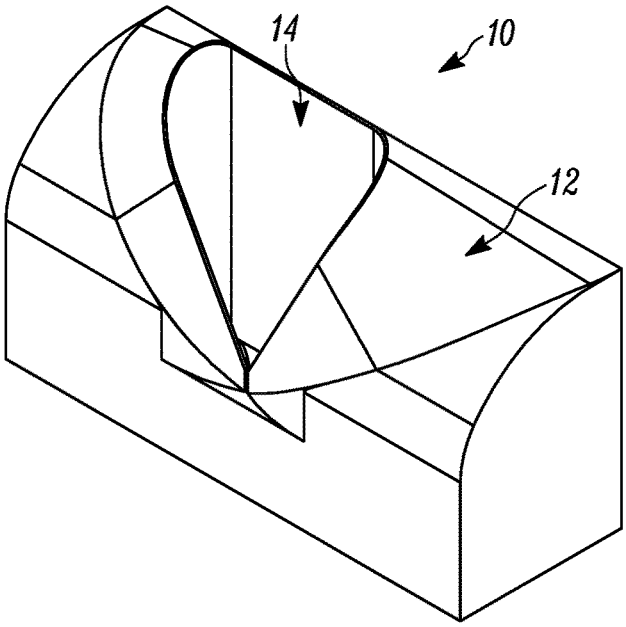
FIG. 1 of the drawings is a perspective view of the forming station of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the forming station for forming pairs of three side seal pouches is shown generally at 10. Such forming stations may be utilized to form pairs of pouches, such as condiment packages, yogurt packages, syrup packets, among others. Of course, the formed pouches are not limited in size and not limited to any particular application or any particular fill material. The forming station is configured for use in association with a form fill seal filler, such as those manufactured by Winpak Lane, of San Bernardino, Calif. It will be understood that the former described herein can be used in place of the former that is described in U.S. Pat. No. 6,006,501 issued to Davis et al and assigned to Winpak Lane, Inc., as well as U.S. Pat. No. Des. 399,512 issued to Davis et al and assigned to Winpak Lane, Inc. The entire disclosure of each of the foregoing patent and design patent is incorporated by reference in its entirety.

Figure 2:
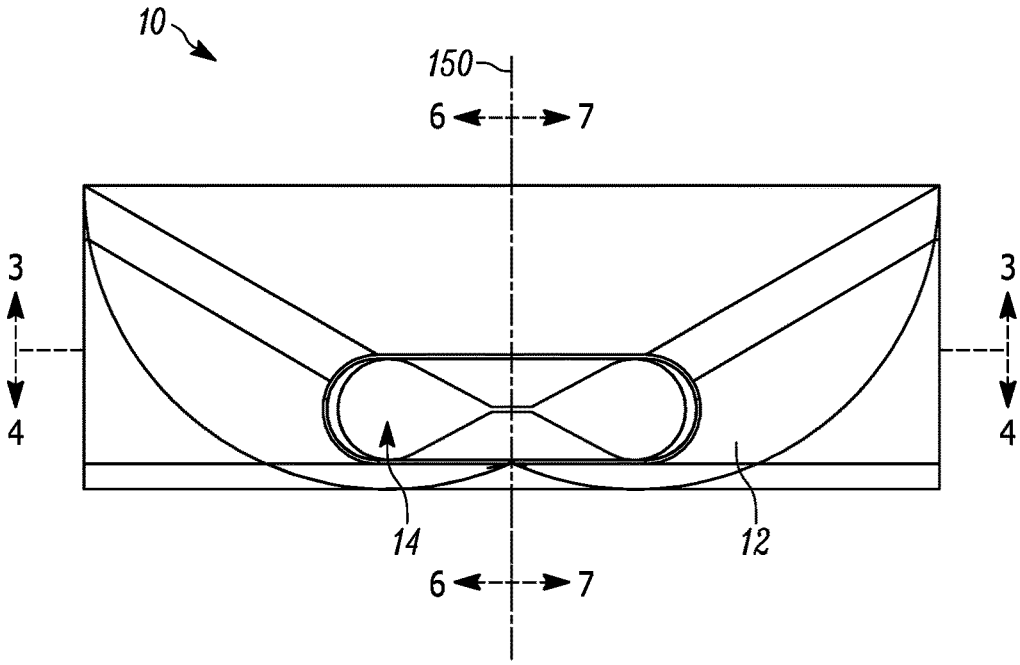
FIG. 2 of the drawings is a top plan view of the forming station of the present disclosure.
Figure 3:
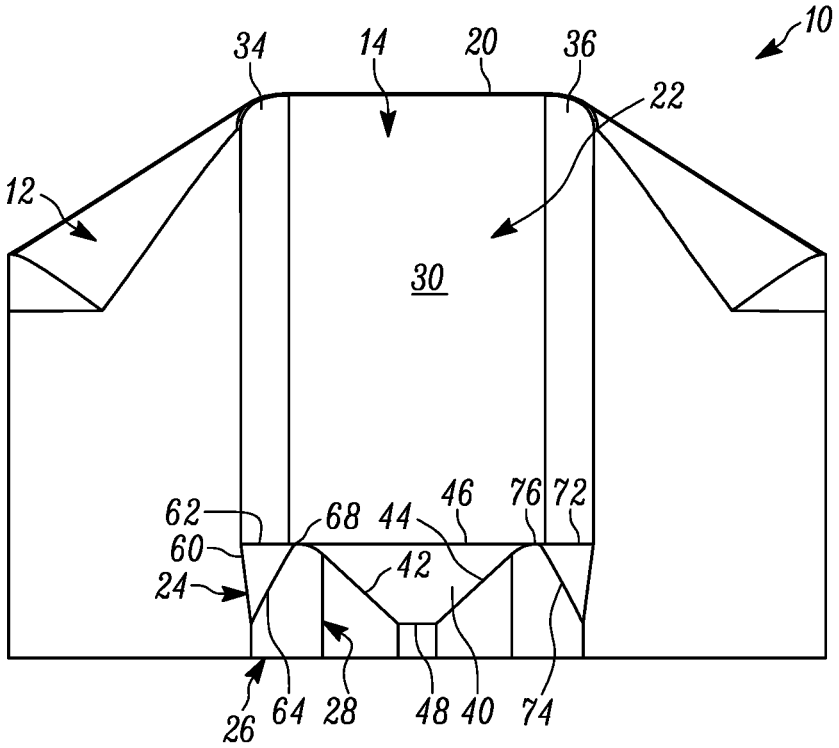
FIG. 3 of the drawings is a cross-sectional view of the forming station of the present disclosure, taken generally about lines 3-3 of FIG. 2.
Figure 4:
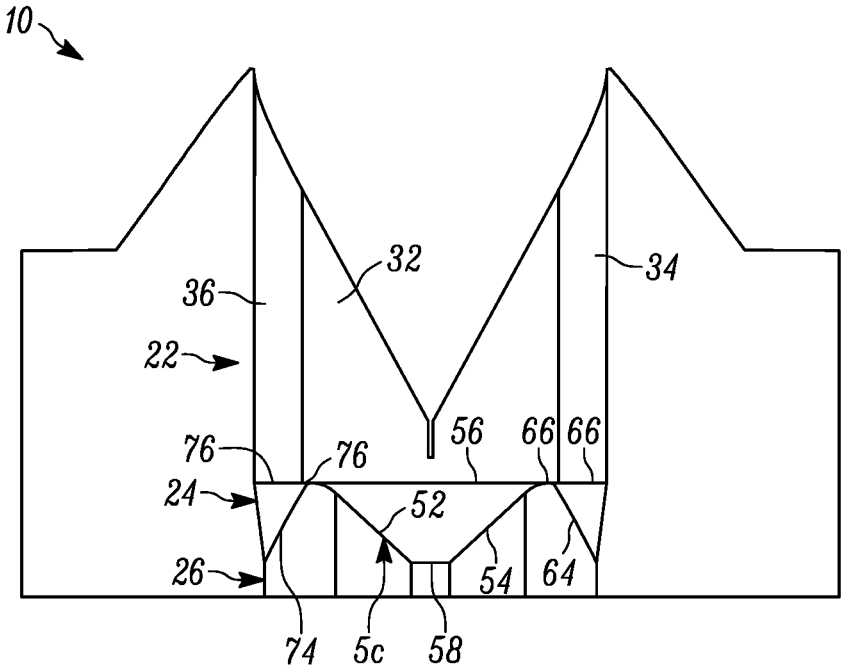
FIG. 4 of the drawings is a cross-sectional view of the forming station of the present disclosure, taken generally about lines 4-4 of FIG. 2.
Figure 5:
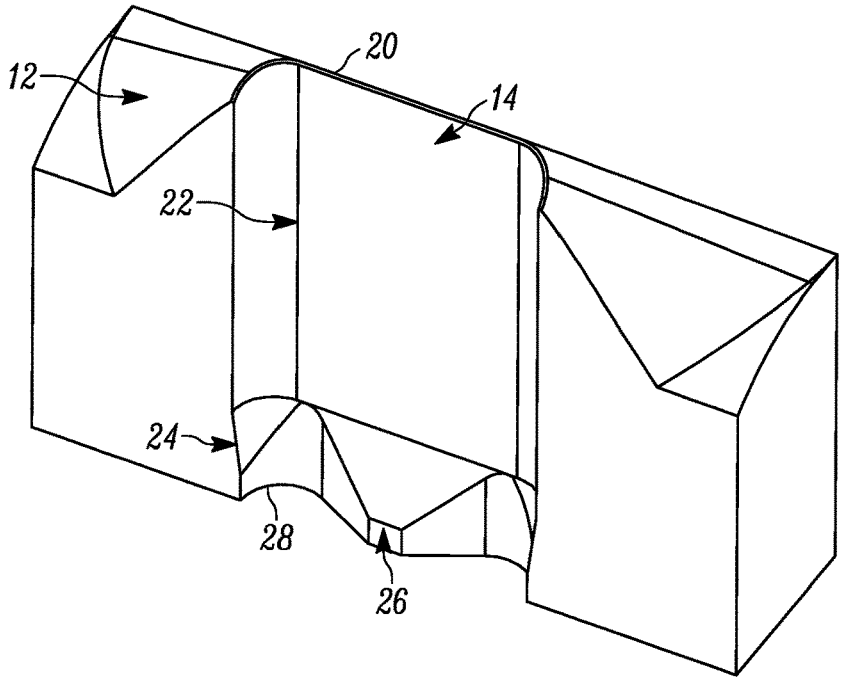
FIG. 5 of the drawings is a perspective cross-sectional view of the forming station of the present disclosure, taken generally about lines 3-3 of FIG. 2.
Figure 6:
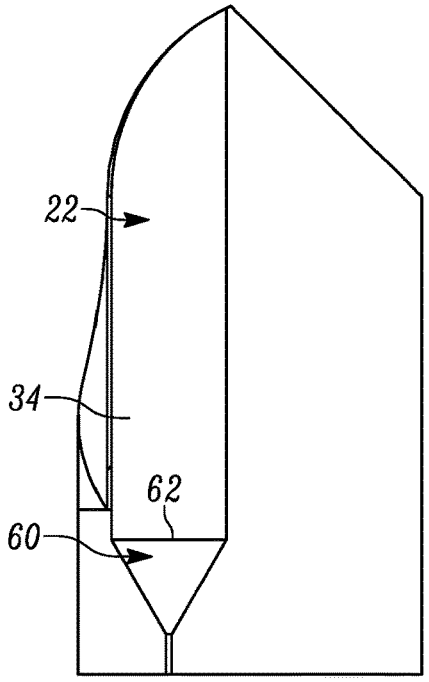
FIG. 6 of the drawings is a cross-sectional view of the forming station of the present disclosure, taken generally about lines 6-6 of FIG. 2.
Figure 7:
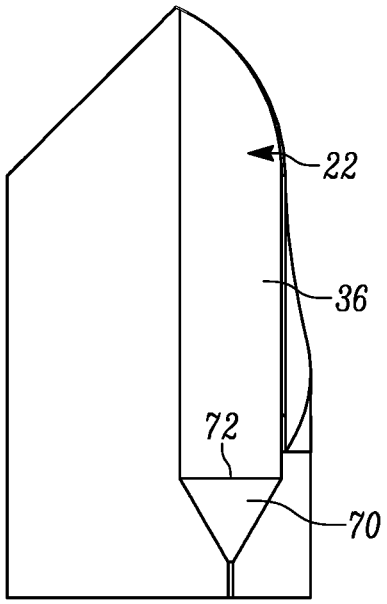
FIG. 7 of the drawings is a cross-sectional view of the forming station of the present disclosure, taken generally about lines 7-7 of FIG. 2.

The forming station 10 of the present disclosure is shown in FIGS. 1 and 2 as comprising shaped outer top surface 12, and inner forming slot 14. The forming station may be formed from a polymer material, or from a metal or metal alloy. It will be understood that the forming station may be formed from a single piece of material that is milled or otherwise molded to the final configuration. In other configurations, the forming station may be formed from a plurality of different materials.

Figure 8:
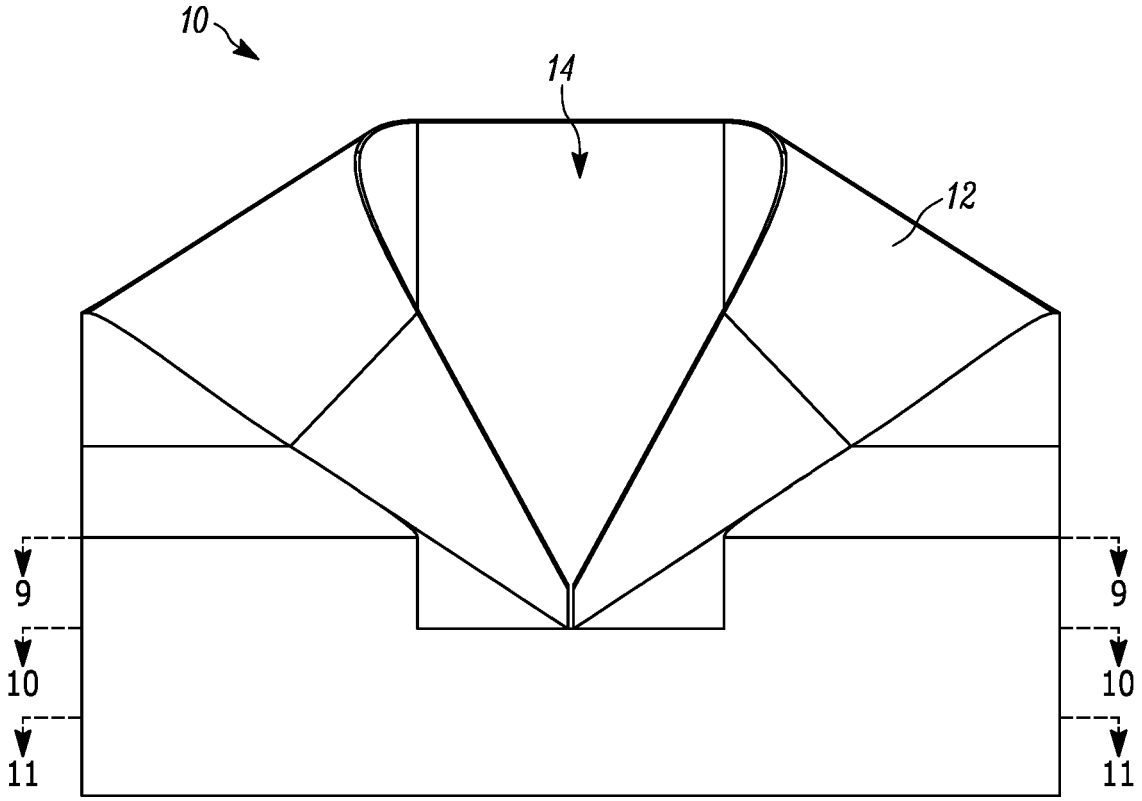
FIG. 8 of the drawings is a front elevational view of the forming station of the present disclosure.
Figure 9:
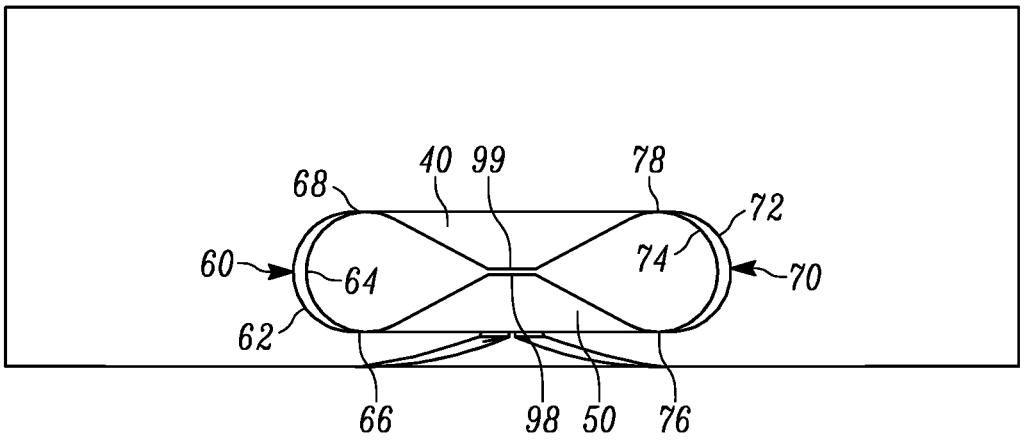
FIG. 9 of the drawings is a cross-sectional view of the forming station of the present disclosure, taken generally about lines 9-9 of FIG. 8.
Figure 10:
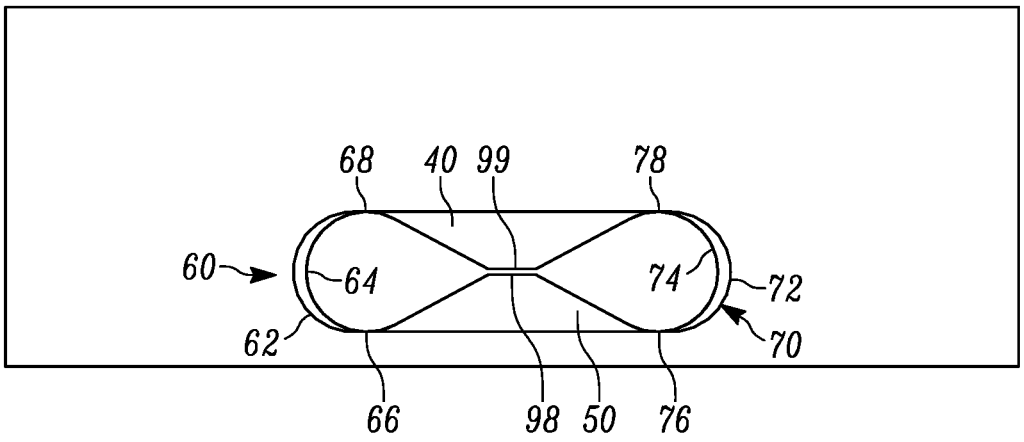
FIG. 10 of the drawings is a cross-sectional view of the forming station of the present disclosure, taken generally about lines 10-10 of FIG. 8.
Figure 11:
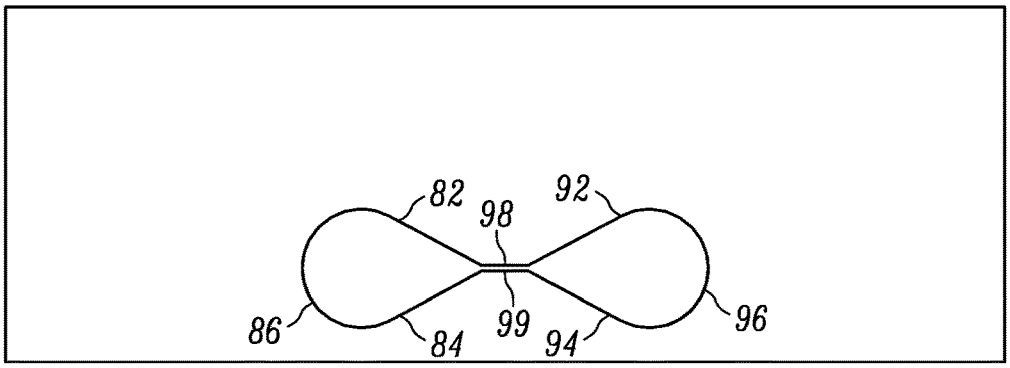
FIG. 11 of the drawings is a cross-sectional view of the forming station of the present disclosure, taken generally about lines 11-11 of FIG. 8.
Figure 12:
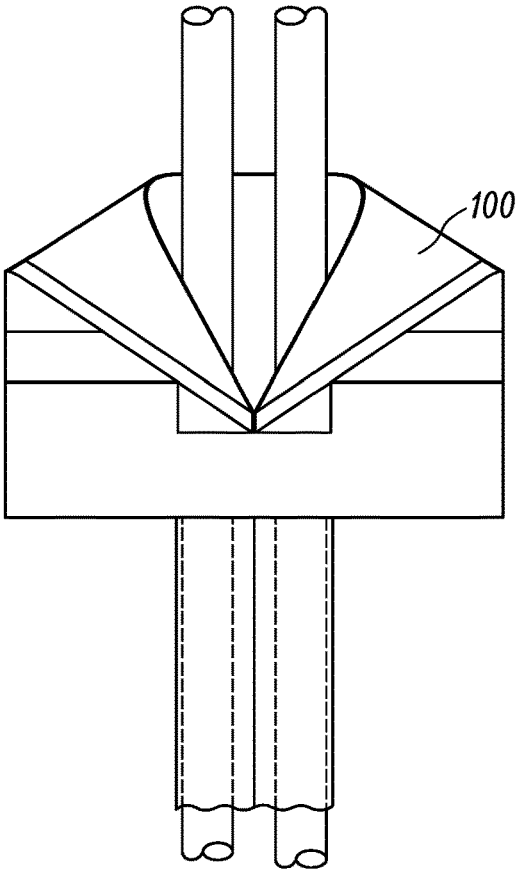
FIG. 12 of the drawings is a front elevational view of the forming station of the present disclosure having a film extending therethrough and formed thereby.
Figure 13:
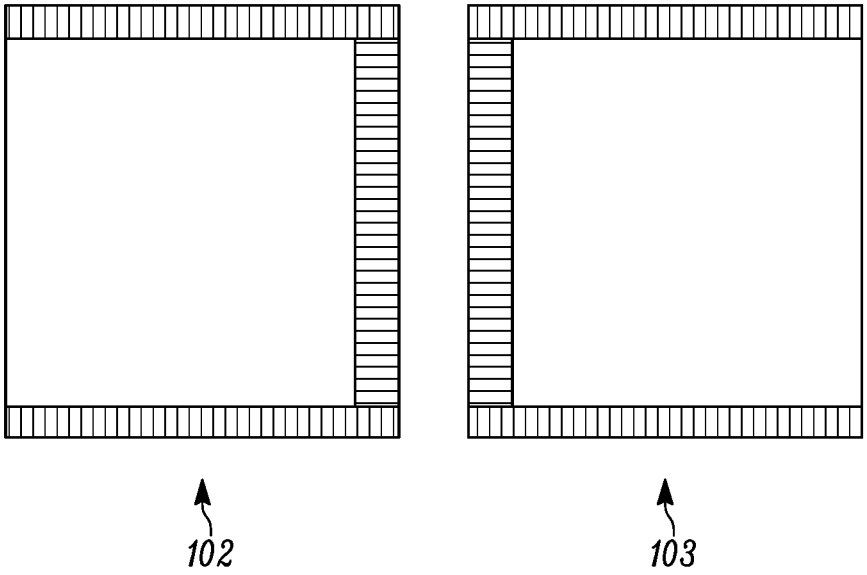
FIG. 13 of the drawings is a front elevational view of two exemplary packets formed by the equipment of the type to which the forming station is coupled.

With reference to FIG. 12, the shaped outer top surface 12 is configured to take a strip of material, such as material 100, of a particular width (from which the packets are formed) (see the '501 patent), and to maneuver the material inside out and into the proper shape to form the pairs of three side seal pouches, by forming the configuration into a FIG. 8 shape. An illustrative sample of such a pair of three side seal pouches 102, 103 is shown in FIG. 13. It will be understood that the same shape that is disclosed in the '512 patent and the '501 patent may be utilized, as well as variations and different structures therefrom. The shaped outer top surface 12 includes back portion 16, first side front portion 17, second side front portion 18 and front slit 19 (wherein the first side front portion meets the second side front portion).

With reference now to FIGS. 2 through 11, the inner forming slot 14 comprises a substantially symmetrical configuration (i.e., a mirror image taken about plane 150 that transversely bisects the slot). The inner forming slot 14 includes upper entry edge 20, upper portion 22, transition portion 24, and lower portion 26. It will be understood that initially, the material is directed into an elongated hoop configuration, and then formed into the FIG. 8 shape. The upper entry edge 20 comprises a three dimensional shape that has a lower front portion and a higher back portion with a split in the front portion. Such a configuration is utilized to urge the strip of material over itself and into the elongated hoop like configuration.

The upper portion 22 of the inner forming slot 14 includes back wall 30, front wall 32, first side curved portion 34 and second side curved portion 36. The back wall and the front wall are substantially parallel to each other and substantially perpendicular to the flow of the strip of material. The first and second side curved portions define semi-circular cross-sectional configurations. In the configuration shown, the cross-sectional configuration of the upper portion (once below the upper entry edge 20), is substantially uniform (although slight variations are contemplated).

The transition portion 24, positioned downstream of the upper portion, includes first central inwardly projecting surface 40, second central inwardly projecting surface 50, first side inwardly projecting surface 60 and second side inwardly projecting surface 70. The first central inwardly projecting surface is inclined inwardly and downwardly at a particular angle or range of angles relative to the back wall, and includes first side edge 42, second side edge 44, top edge 46 and bottom edge 48, which cooperate to define a substantially planar surface having trapezoidal configuration.

Similarly, the second central inwardly projecting surface 50 is a substantial mirror image of the first inwardly projecting surface 40 and includes first side edge 52, second side edge 54, top edge 56 and bottom edge 58. Similarly, the second inwardly projecting surface 50 comprises a substantially planar surface having a trapezoidal configuration.

With the two surfaces inclined downwardly and inwardly, the bottom edges 48, 58 meet and are spaced apart so as to define a gap therebetween wherein the layers of the strip material are brought together in preparation of the formation of a seal thereat. The top edges are substantially longer than the bottom edges, and configured to slowly urge the strip of material into a FIG. 8 configuration.

Problematically, the above configuration, without the first and second side inwardly projecting surfaces can cause alignment problems, depending on the different materials used and the like. It is necessary to adjust the initial path (and in many instances to keep adjusting the initial path) of the film prior to entry into the former so as to limit the amount of scrap as well as to limit alignment problems and film wrinkling. With the addition of the below structure of the side inwardly projecting surfaces 60 and 70, in cooperation with the other structures of the upper portion and the transition portion, alignment problems can be eliminated, as well as the need to repeatedly align or re-align the film during operation. Such is the case even with relatively heavy films and films that include foils and the like. With conventional formers, and formers of the prior art, the use of such films was difficult and often not possible at customary processing speeds, if at all. The present former allows for the use of such films, due, at least in part, to the path of the film.

The first side inwardly projecting surface 60 includes upper edge 62, lower edge 64, and is inclined inwardly and downwardly. In the configuration shown, the surface is curved only in one direction (essentially in the horizontal, or side to side direction) and planar in the top to bottom direction. The intersection of the upper and lower edges defines a slice configuration (i.e., a slice of a cylinder or the like) with a first intersection 66 and a second intersection 68. It is contemplated that this slice may have a curvature in multiple directions, and that the radius of curvature may be constantly changing or may mimic the radius of curvature (i.e., correspond to) of the first side curved portion 34.

Similarly, the second inwardly projecting surface 70 includes upper edge 72, lower edge 74, and is inclined inwardly and downwardly. In the configuration shown, the surface is curved only in one direction (essentially in the horizontal, or side to side direction) and planar in the top to bottom direction. The intersection of the upper and lower edges defines a slice configuration (i.e., a slice of a cylinder or the like) with a first intersection 76 and a second intersection 78. It is contemplated that this slice may have a curvature in multiple directions, and that the radius of curvature may be constantly changing or may mimic the radius of curvature (i.e., correspond to) of the second side curved portion 36.

Generally, the top edge of the first central inwardly projecting surface and the top edge of the second central inwardly projecting surface, along with the upper edge of the first side inwardly projecting surface and the second side inwardly projecting surface cooperatively define a transition plane, with the lower portion including a lower exit edge at a lower end thereof, the lower exit edge defining a plane that is parallel to the transition.

The lower portion 26 essentially extends from the lower edges/bottom edges of the first central inward projecting surface, the second central inward projecting surface and the first and second side inwardly projecting surfaces, or, downstream of the transition portion. The lower portion 26 includes a cross-section that is smaller than that of the upper portion, and that has been essentially formed into the FIG. 8 configuration. Included in the lower portion are first side pouch shape 80 and second side pouch shape 90, as well as the central seal surface opposing walls 98, 99. The first side pouch shape 80 includes first inclined wall 82, second inclined wall 84 and arcuate outer wall 86. The second side pouch shape 90 includes first inclined wall 92, second inclined wall 94 and central outer wall 96. In the configuration shown, the first and second inclined walls are continuous, that is, they lack inward projections, of the type that would be utilized to form gusseted configurations. The first inclined walls meet at the central seal surface 98 and the second inclined walls meet at central seal surface 99.

A lower exit edge 28 is defined at the bottom end of the lower portion. The exiting strip of film is now in a FIG. 8 configuration and ready for sealing and filling. Advantageously, the transition region provides the necessary urging of the strip of film that is formed by the outer top surface and the upper portion of the inner forming slot. Without the transition region and the smaller lower portion, it is necessary to make small adjustments to the inward feed of the material, in an effort to preclude wrinkling and improper alignment of the different materials. With the construction shown in the forming station, such adjustment is not necessary, and the structure is configured to handle films from across the spectrum of construction, thickness and flexibility, including films that have foils therein.

It will be understood that the slot defines a length between the opposing curved portions and a width between the opposing front and back walls. Through the transition portion, not only is the width reduced between the opposing front and back walls (and indeed, at the middle, the two are brought quite close together), but the length is likewise reduced between the opposing curved portions. Thus, the FIG. 8 generally defined by the time the lower portion is reached has a shorter length than the same at the entry to the transition region.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A forming station for forming pairs of three side seal pouches comprising:

a shaped outer top surface;

an inner forming slot substantially surrounded by the shaped outer top surface and meeting at an upper entry edge, the inner forming slot defined by:

an upper portion, including a back wall, a front wall opposite the back wall, a first side curved portion and a second side curved portion opposite the first side curved portion, the first side curved portion and the second side curved portions spanning between the back wall and the front wall; and a transition portion downstream of the upper portion and downstream of the upper entry edge including a first central inwardly projecting surface extending inwardly from the back wall, and a second central inwardly projecting surface extending inwardly from the front wall, a first side inwardly projecting surface that is curved extending inwardly and downwardly from the first side curved portion and a second side inwardly projecting surface that is curved extending inwardly and downwardly from the second side curved portion wherein the transition portion has a cross-section that is smaller than the upper portion caused, at least in part, by the first side inwardly projecting surface and the second side inwardly projecting surface.

2. The forming station of claim 1 further comprising a lower portion, the lower portion positioned downstream of the transition portion, the lower portion including, a first side pouch shape having a first inclined wall extending from the first central inwardly projecting surface, a second inclined wall extending from the second central inwardly projecting surface, and an arcuate outer wall extending from the first side inwardly projecting surface;

a second side pouch shape having a first inclined wall extending from the first central inwardly projecting surface, a second inclined wall extending from the second central inwardly projecting surface, and an arcuate outer wall extending from the second side inwardly projecting surface;

a first side opposing wall extending from the first central inwardly projecting surface between the first inclined wall of the first side pouch shape and the first inclined wall of the second side pouch shape; and a second side opposing wall extending from the second central inwardly projecting surface between the second inclined wall of the first side pouch shape and the second inclined wall of the second side pouch shape.

3. The forming station of claim 2 wherein the arcuate outer wall of the first side pouch shape is a continuous curve and wherein the arcuate outer wall of the second side pouch is a continuous curve.

4. The forming station of claim 3 wherein the first side pouch shape and the second side pouch shape are substantially mirror image of each other taken about a plane that bisects the inner forming slot from the front wall to the back wall.

5. The forming station of claim 4 wherein:

an initial width is defined between the front wall and the back wall of the upper portion, and wherein an initial length is defined as the largest distance between the first side curved portion and the second side curved portion that is parallel to the front wall, a final minimal width is defined between the first side opposing wall and the second side opposing wall, and wherein final length is defied between the arcuate wall of the first side pouch shape and the arcuate wall of the second side pouch shape, wherein, the initial width is greater than the final minimal width and the initial length is greater than the final length.

6. The forming station of claim 5 wherein the arcuate outer wall of the first side pouch shape defines an arcuate outer wall width and the arcuate outer wall of the second side pouch shape likewise defines the arcuate outer wall width, with the arcuate outer wall width being substantially identical to the initial width in at least a portion thereof.

7. The forming station of claim 2 wherein the first central inwardly projecting surface further includes a first side edge and a second side edge, that extend downwardly and toward each other, such that a width of the first central inwardly projecting surface narrows in the downstream direction.

8. The forming station of claim 7 wherein the second central inwardly projecting surface further includes a first side edge and a second side edge, that extend downwardly and toward each other, such that a width of the second central inwardly projecting surface narrows in the downstream direction.

9. The forming station of claim 8 wherein the first side inwardly projecting surface has an upper edge and a lower edge wherein the upper edge and the lower edge meet at a first intersection proximate the first central inwardly projecting surface proximate a top edge thereof and at a second intersection at the second central inwardly projecting surface at a top edge thereof, to, in turn define a slice.

10. The forming station of claim 9 wherein the second side inwardly projecting surface has an upper edge and a lower edge wherein the upper edge and the lower edge meet at a first intersection proximate the first central inwardly projecting surface at a top edge thereof and at a second intersection at the second central inwardly projecting surface proximate a top edge thereof, to in turn define a slice.

11. The forming station of claim 10 wherein a portion of the first side pouch shape extends to the top edge of the first central inwardly projecting surface and the top edge of the second central inwardly projecting surface.

12. The forming station of claim 11 wherein a portion of the second side pouch shape extends to the top edge of the first central inwardly projecting surface and the top edge of the second central inwardly projecting surface.

13. The forming station of claim 2 wherein the first side opposing wall and the second side opposing wall of the lower portion are substantially parallel to each other, and of substantially the same size.

14. The forming station of claim 10 wherein the top edge of the first central inwardly projecting surface and the top edge of the second central inwardly projecting surface, along with the upper edge of the first side inwardly projecting surface and the second side inwardly projecting surface cooperatively define a transition plane, with the lower portion including a lower exit edge at a lower end thereof, the lower exit edge defining a plane that is parallel to the transition plane.

15. A forming station for forming pairs of three side seal pouches comprising:

a shaped outer top surface;

an inner forming slot substantially surrounded by the shaped outer top surface and meeting at an upper entry edge, the inner forming slot defined by:

an upper portion, including a back wall, a front wall opposite the back wall, a first side curved portion and a second side curved portion opposite the first side curved portion, the first side curved portion and the second side curved portions spanning between the back wall and the front wall;

a lower portion terminating with a lower exit edge, the lower portion including a first side pouch shape and a second side pouch shape, each pouch shape having a first inclined wall, a second inclined wall and an arcuate outer wall; and a transition portion between the upper portion and the lower portion, the transition portion inwardly directing at least a portion of the front wall and the back wall into the first and second inclined walls of the first side pouch shape and the second side pouch shape, and having opposing inwardly inclined, curved surfaces, a first inwardly inclined, curved surface inwardly directing the first side curved portion into the arcuate outer wall of the first side pouch shape and a second inwardly inclined, curved surface inwardly directing the second side curved portion into the arcuate outer wall of the second side pouch shape.

16. The forming station of claim 15 wherein the arcuate outer wall of the first side pouch shape and the arcuate outer wall of the second side pouch shape are each continuous curves.

17. The forming station of claim 16 wherein the first and second curved portion have a width that substantially matches a width of each of the arcuate outer wall of the first side pouch and the arcuate outer wall of the second side pouch.

18. The forming station of claim 17 wherein the first and second curved portions are each continuous curves.

19. The forming station of claim 18 wherein the first side pouch shape and the second side pouch shape are substantially mirror images of each other.

* * * * *